United States Patent [19]

Herscovici et al.

[11] Patent Number: 4,776,816

[45] Date of Patent: Oct. 11, 1988

[54] ELECTRICAL CONNECTOR

[75] Inventors: Yves Herscovici, Saint-Germaine-en-Laye; Jacques Benoist, Saint-Cloud, both of France

[73] Assignee: Souriau & Cie, Boulogne, France

[21] Appl. No.: 455,456

[22] Filed: Jan. 4, 1983

[51] Int. Cl.[4] ..... H01R 13/426

[52] U.S. Cl. ..... 439/744; 439/871

[58] Field of Search ..... 339/217 S, 256 R; 439/744, 745, 871

[56] References Cited

U.S. PATENT DOCUMENTS

| | | | |
|---|---|---|---|
| 3,383,642 | 5/1968 | Nava et al. | 339/217 S |
| 3,475,720 | 10/1969 | Culver | 339/217 S |
| 3,697,935 | 10/1972 | Drapkin | 339/217 S |
| 4,082,398 | 4/1978 | Bourdon et al. | 339/217 S |

*Primary Examiner*—Gil Weidenfeld
*Assistant Examiner*—Gary F. Paumen
*Attorney, Agent, or Firm*—Sughrue, Mion, Zinn, Macpeak & Seas

[57] ABSTRACT

An electrical connector comprises a supporting base (210); a locking clip (217) disposed in an open recess (214) in the base, the clip being constituted by a body defining a cavity having resilient stop means (218, 219); and an electrical contact disposed (221) co-operatively in the body of the clip. Said contact is constituted by an oblong member with a ring (220) rigidly mounted therearound and is situated in the cavity in such a manner that the ring (220) co-operates on one side (223) with the stop means (218, 219) to limit its displacement in one direction. The cavity is delimited at the other side (224) by at least one resilient tongue (233) turned towards the inside of the cavity, the tongue being suitable for co-operating with the other side of the ring in such a manner that the distance between the stop means (218, 219) and the contact surface of the tongue (233) is less than the thickness of the ring. This ensures that the tongue exerts a resilient force against the ring, thereby keeping the ring pressed against the stop means and preventing it from rattling about in the cavity and damaging the relatively soft supporting base.

3 Claims, 3 Drawing Sheets

ELECTRICAL CONNECTOR

The present invention relates to a connector for connecting cables of electrical conductors. It is applicable to male, female, or hermaphrodite type contacts.

BACKGROUND OF THE INVENTION

There exist connectors comprising a supporting base with a contact-receiving locking clip located in a recess in said base. The clip is constituted by a body which is generally force fitted into the recess, and which defines a cavity having resilient stop means to one side thereof. An electric contact is co-operatively disposed in the body of the clip, and the contact is generally constituted by an oblong member with a ring situated therearound. The electrical contact is situated inside the cavity to co-operate on one side with the stop means of the clip to limit displacement of the contact in one direction, and on the other side with another stop on the supporting base to limit displacement of the contact in the other direction.

Generally speaking, the clip is made of rigid conductor material which is resilient to some degreee, eg. beryllium, while the supporting base is made of a softer insulating material such as a plastics material. Generally this kind of connector is intended to be used on electrical cables to be found in the proximity of vibrating machinery, eg. motors or the like.

Because of the vibrations, which may be at several thousand hertz, the contact (which necessarily possesses some mass), is subjected to the vibrations and repeatedly hammers against the stop made on the supporting base.

Thus, after some time under such conditions, the base is damaged by the hammering contact, and it sometimes happens that the stop is sufficiently degraded for it to cease restraining the contact which consequently escapes from the base. It is thus incontestable that connectors made as described above have a drawback which results in an extremely short service life under some conditions of use.

Preferred embodiments of the present invention is mitigate the drawback described above and provide a connector of the same type as that described above but having a much longer service life. This is achieved by holding the contact member very rigidly in the base and thus preventing it, when subjected to vibrations, from deteriorating the material of the base.

SUMMARY OF THE INVENTION

The present invention provides an electrical connector comprising: a supporting base; a locking clip disposed in an open recess in said base, said clip being constituted by a body defining a cavity including resilient stop means; and an electrical contact disposed co-operatively in the body of said clip, said contact being constituted by an oblong member with a ring rigidly mounted therearound, said contact being situated in said cavity in such a manner that said ring co-operates on one side with said stop means to limit its displacement in one direction; the improvement wherein said cavity is delimited at the other side of the ring by at least one resilient tongue turned towards the inside of the cavity, said tongue being suitable for co-operating with said other side of said ring in such a manner that the distance between the stop means and the contact surface of said tongue, when undeflected is less than the thickness of said ring, whereby said tongue deflects to exert a resilient force against said ring, said resilient force tending to keep said ring pressed against said stop means.

Said body may be formed from a substantially cylindrically shaped folded sheet, in which case said tongue is constituted by a deformation of said sheet turned down towards the inside of said cylinder, said deformation being substantially thumb tab shaped.

Said body may include three thumb tabs situated at substantially 120° intervals around the periphery of said cylinder.

BRIEF DESCRIPTION OF THE DRAWINGS

An embodiment of the present invention is described by way of example with reference to the accompanying drawings, in which.

MORE DETAILED DESCRIPTION

Figure 1:
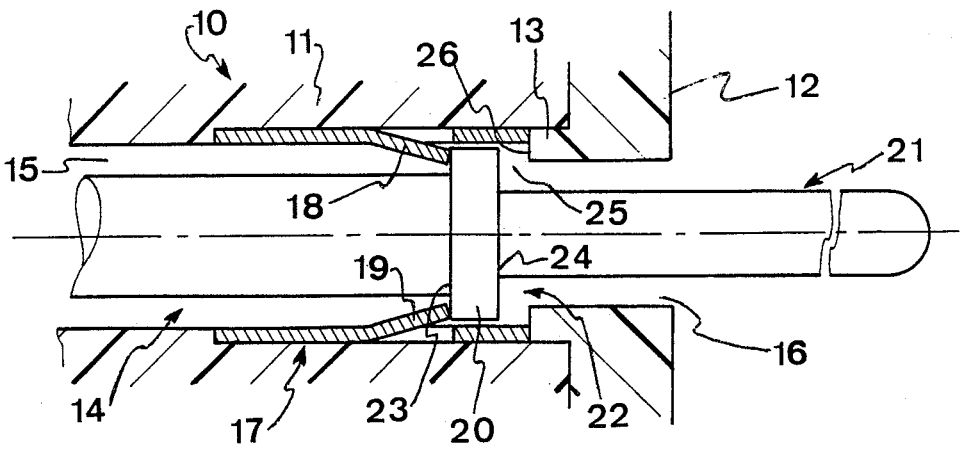
FIG. 1 PRIOR ART
FIG. 1 shows a prior art connector.

With reference to FIG. 1, a prior art connector essentially comprises a supporting base 10 made of two parts 11 and 12 which are fitted together by a flange 13 on the part 12 being received in the part 11. The two parts 11 and 12 of the base 10 define a recess 14 which is open at both ends 15 and 16. In the recess 14 there is a clip 17 which is constituted essentially by a folded metal sheet with at least two tabs 18 and 19 to form a stop for a ring 20 around an oblong contact member 21.

The contact is disposed inside the recess 14 and inside a cavity 22 defined inside the clip 17 in such a manner that the ring 20 is stopped on one side 23 by the tabs 18 and 19, and on the other side by the penetrating flange 13 of the part 12. However, since the two parts 11 and 12 of the base 10 are made of a material such as a plastics material, it is not possible to make these parts very accurately, and consequently there is always a space 25 between the side 24 of the ring 20 and the end 26 of the flange 13.

Thus, when such a connector is placed next to a vibrating machine, the ring is rattled back and forth between the end 26 of the flange 13 and the two tabs 18 and 19, thereby hammering against the flange 13, which over the course of time becomes so damaged that the contact 21 can escape from the supporting base 10. This is a distinct drawback which can be avoided by the embodiment of the invention shown in FIG. 2.

Figure 2:
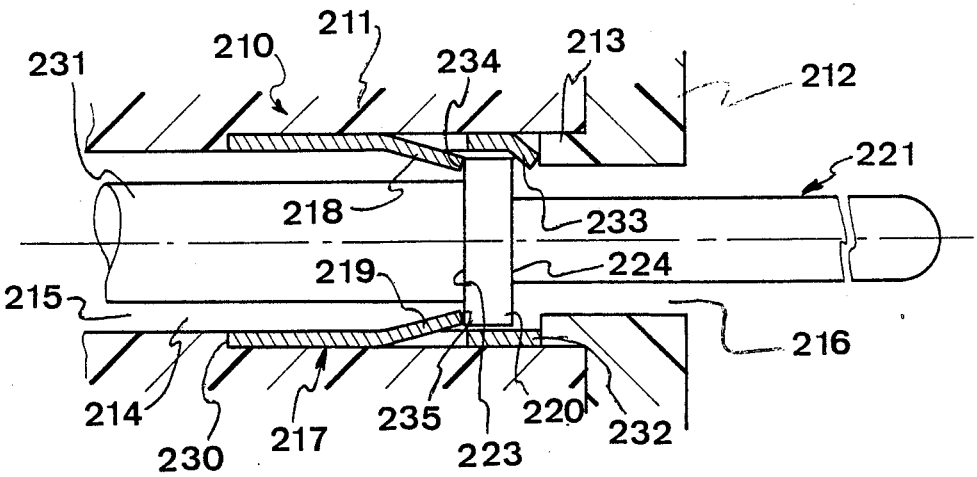
FIG. 2 shows an embodiment of the present invention in partial section.

The conductor shown in FIG. 2 comprises a supporting base 210 constituted by two parts 211 and 212, with a flange 213 of the part 212 penetrating into the part 211 of the base 210. The two parts 211 and 212 define a recess 214 which is open at its ends 215 and 216 to enable a contact 221 to be positioned in the recess 214. Further, in the recess 214, and more particularly in the part 211, there is a clip 217 which is stopped at one end by a step 230 in the part 211 of the base 210.

As drawn, the clip 217 includes two tabs 218 and 219 which constitute stops for a ring 220, which together with an oblong member 231 constitutes the contact 221. Further the clip 217 has at least one tongue 233 turned down towards the inside of the recess 214 to constitute a resilient stop at the end 232 facing the part 212.

The ring 220 of the contact 221 is defined such that its thickness between its faces 223 and 224 is slightly greater than the distance between the contact point where tongue 233 projects from the clip body and the end 234 of the tab 218.

Thus, when the contact 221 is inserted in the recess and in the clip, the ring 220 in the embodiment shown has its side 223 stopped by the ends 234 and 235 of the tabs 218 and 219, and its other side 224 stopped by the tongue 233 which exerts a resilient force on the ring 220 tending to press and pinch the ring 220 between the wall of the tongue 233 and the ends 234 and 235 of the tabs 218 and 219 respectively.

Figure 3:
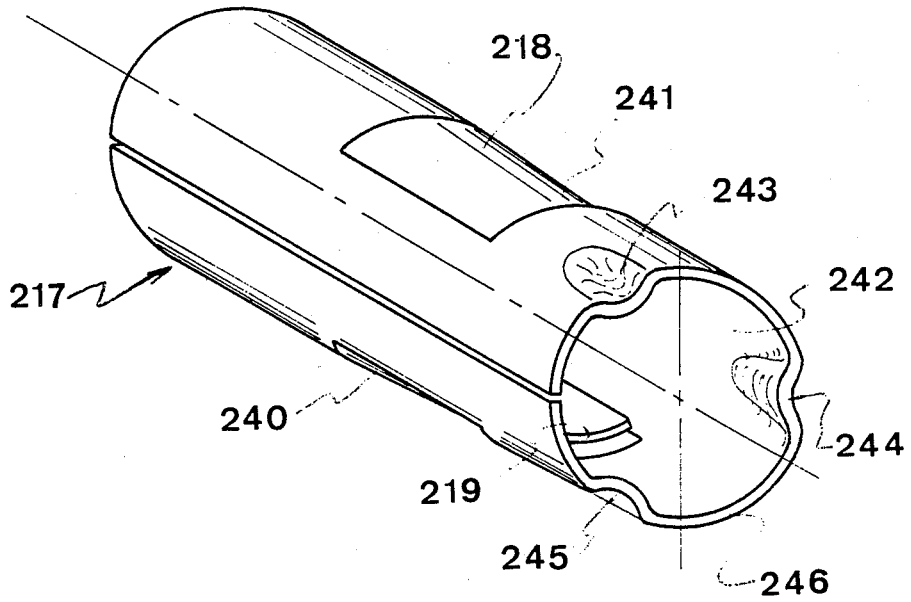
FIG. 3 is a perspective view of a portion of the connector shown in FIG. 2.

In the embodiment shown in FIG. 2, only one tongue 233 is visible, but it is clear that the clip 217 could advantageousy have several tongues 233, eg. three tongues 243, 244 and 245 as shown in FIG. 3.

To do this, in an advantageous embodiment, the clip 217 is made from a sheet of metal which is folded to take up a substantially cylindrical shape having two cut out tabs 240 and 241 turned towards the inside 242 of the cylinder to constitute two tab stops 218 and 219. In contrast, the three resilient tongues 243, 244, and 245 are made by deforming the end 246 of the cylinder-forming sheet towards the inside 242 of the cylinder without any cutting out. Such deformations are obtained by pressing and constitute three thumb-tab shaped portions at 120° spacing.

This deformation has the advantage of being highly resilient under stress which helps to jam the ring on the contact and hold it firmly in place.

Figure 4:
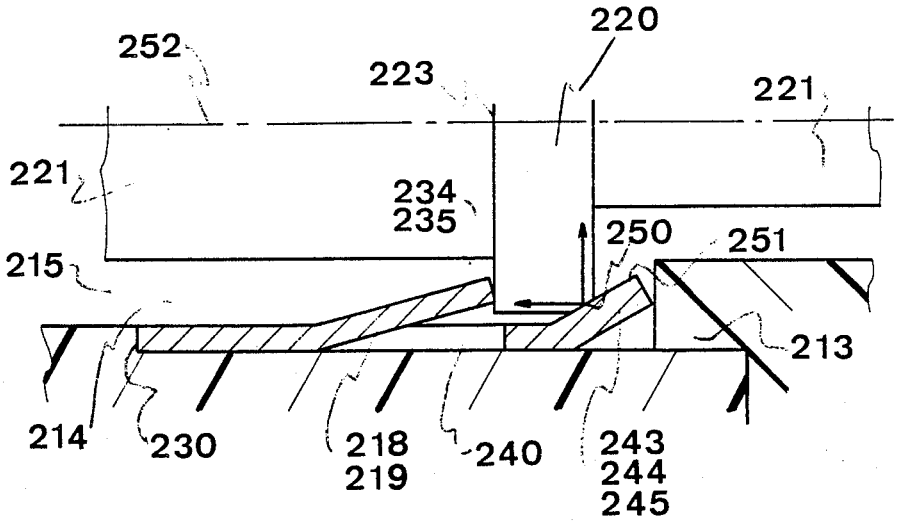
FIG. 4 shows a portion of the FIG. 2 connector in section and to a larger scale, enabling the operation and the advantages of a connector in accordance with the invention to be better understood.

With reference to FIG. 4, it can be seen that the contact 221 in inserted into the base from the end 215 thereof, and when the ring 220 reaches the tabs 218 and 219, it pushes them so that they tend to return to the places 240 from which they were cut out to let the ring pass.

Thus, once the ring 220 has gone past the ends 234 and 235 it is stopped by the tabs moving back in behind the face 223 of the ring 220.

Furthermore, the leading corner 250 of the ring 220 comes into contact with the inside face 251 of the tongue 243, for example, which then exerts a resilient force which can be decomposed into two perpendicular components: as per the arrows, FIG. 4 one of which is parallel to the axis 252 of the contact 221, whereby the ring 220 is completely held captive between the ends 234 and 235 and the three tongues 243, 244 and 245 as shown in FIG. 3, for example, thereby centering the ring within the female locking clip.

Thus, since the clip is held fast in the recess 214 given that the clip is usually force fitted therein and may also be held between end stops 230 and 213, and given that the contact 221 is held fast, the conductor assembly is completely homogenous and in particular is not deformed by vibrations.

Clearly the embodiment which has been described above relates to one male contact, but the invention is likewise applicable to multi-contact connectors, regardless of whether the contacts are male, female or hermaphrodite.

Further, in known manner, the contacts are for connection to different electrical conductors which need connecting thereto, but this is not difficult and is not described further.

We claim:

1. An electrical connector comprising:

a supporting base having an open recess;

a female locking clip disposed in said open recess in said base, said clip being constituted by a tubular body defining a cavity including resilient stop means; and a male electrical contact disposed cooperatively in the body of said clip, said contact being constituted by an oblong member with a radially enlarged ring rigid therewith, said contact being situated in said cavity in such a manner that said ring contacts on one side with said stop means to limit its displacement in one direction;

the improvement wherein said cavity is delimited at the other side of the ring by a plurality of resilient tongues carried by said clip body at equally spaced circumferential positions, turned towards the inside of the cavity forming inclined contact surfaces, said tongue contact surfaces being adjacent said other side of said ring and the distance between the stop means and the contact surface of each tongue, when undeflected, being less than the thickness of said ring, whereby the leading corner of the ring being in contact with the inclined contact of said tongues exerts on said ring resilient forces having an axial component and a radial component tending to keep said ring pressed axially against said stop means and radially centered within said female locking clip.

2. A connector according to claim 1, wherein said body is formed from a substantially cylindrically shaped folded sheet, said tongues are constituted by deformations of said sheet, said deformations being turned down towards the inside of said folded sheet and being substantially thumb tab shaped.

3. A connector according to claim 2, wherein said body includes three said deformations situated at substantially 120° intervals around the periphery of said folded sheet.

* * * * *